US005584966A

United States Patent [19]

Moffett

[11] Patent Number: 5,584,966

[45] Date of Patent: Dec. 17, 1996

[54] PAPER FORMATION

[75] Inventor: Robert H. Moffett, Landenberg, Pa.

[73] Assignee: E. I. du Pont de Nemours and Company, Wilmington, Del.

[21] Appl. No.: 391,996

[22] Filed: Feb. 21, 1995

Related U.S. Application Data

[63] Continuation-in-part of Ser. No. 228,977, Mar. 18, 1994, abandoned.

[51] Int. Cl.[6] ..... D21H 21/06

[52] U.S. Cl. ..... 162/168.1; 162/168.2; 162/168.3; 162/175; 162/178; 162/181.6; 162/183

[58] Field of Search ..... 162/168.2, 168.3, 162/183, 181.6, 175, 178, 168.1

[56] References Cited

U.S. PATENT DOCUMENTS

| | | | |
|---|---|---|---|
| 4,643,801 | 2/1987 | Johnson | 162/164.1 |
| 4,927,498 | 5/1990 | Rushmere | 162/168.3 |
| 4,954,220 | 9/1990 | Rushmere | 162/168.3 |
| 5,126,014 | 6/1992 | Chung | 162/164.6 |

*Primary Examiner*—Peter Chin
*Attorney, Agent, or Firm*—George A. Frank

[57] ABSTRACT

An improved method of paper formation, utilizing a combination of polysilicate microgel, anionic and cationic polymers with the optional utilization of an aluminum salt, is provided.

4 Claims, No Drawings

PAPER FORMATION

CROSS REFERENCE TO RELATED APPLICATIONS

This application is a continuation-in-part of application, Ser. No. 08/228,977, filed Mar. 18, 1994, now abandoned.

FIELD OF THE INVENTIONS

This invention is related to papermaking and specifically to a process for improving paper formation utilizing polysilicate microgels in combination with anionic and cationic polymers.

BACKGROUND OF THE INVENTION

U.S. Pat. No. 4,643,801 discloses improved retention and drainage during paper making through the use of coacervate additive system of dispersed silica in combination with anionic and cationic polymers. An improvement in paper formation was also noted. The dispersed silica may take several forms but polysilicate microgels were not disclosed.

U.S. Pat. No. 5,126,014 discloses improved retention and drainage from the use of colloidal silica or bentonite in combination with at least two cationic polymers and an anionic polymer. This patent also explores the conflict and difficulty in achieving optimum formation on the one hand and optimum retention and drainage on the other in paper making. Everyday paper making requires choices depending on which property is more important at any particular time.

U.S. Pat. No. 4,954,220 discloses the utilization of polysilicate microgels in paper making in combination with cationic polymer to achieve improved retention and drainage. Similar process improvements are disclosed in U.S. Pat. No. 4,927,498 by the use of polyaluminosilicate microgel with cationic polymer. The formation (or evenness) of paper is a highly important property which affects many of the paper's overall properties, such as tensile and tear strength, the amount of expansion and contraction occurring at different moisture levels and its appearance and printability. Good formation is important on all grades of paper but particularly in light-weight freesheet for printing. Chemical additives are frequently added to the wet-end of a papermaking process to control formation and also other operating properties such as retention and drainage. In commercial practice, good paper formation must also be accompanied by good retention and drainage, since, if these latter are inadequate, a limit is placed on production. Production requirements force papermakers to focus on improving retention and drainage while maintaining formation within an acceptable range. Consequently, any additive system which might improve paper formation and, at the same time, maintains or increases retention and drainage properties would represent a significant advance.

SUMMARY OF THE INVENTION

The process of this invention to improve the formation of paper in papermaking comprises the steps of (A) adding to an aqueous paper furnish containing pulp and, optionally, inorganic filler a mixture of
  (i) polysilicate microgel,
  (ii) cationic polymer and
  (iii) anionic polymer; and (B) forming and drying the product of step (A).

DETAILED DESCRIPTION OF THE INVENTION

The process of this invention to improve formation of paper during the papermaking process utilizes a combination of polysilicate microgels (PSM) in combination with cationic and anionic polymers. This mixture is added to an aqueous paper furnish which can optionally contain inorganic fillers.

PSM is a network of chained and/or three-dimensionally linked silica particles of approximately 1–2 nm diameter size and surface are of $\geqq 1000m^2$. These have been described in R. K. Iler, "The Chemistry of Silica", published by John Wiley and Sons, N.Y., at pages 174–176 and 225–234. They are also disclosed in U.S. Pat. Nos. 4,954,220 and 4,927,498, both incorporated herein by reference. They are further described in pending U.S. Ser. No. 08/212,744, filed Mar. 14, 1994, also incorporated herein by reference.

The cationic polymers utilized include high molecular weight (1 million or more) cationic starches derived from a variety of sources. A preferred cationic polymer is cationic potato starch containing about 0.01–1 wt. % nitrogen. In certain instances, one can substitute partially or completely other high molecular weight cationic polymers such as cationic polyacrylamide or cationic guar gum for the starch.

Anionic polymers include anionic polyacrylamides. These can be formed by the copolymerization of acrylamide with acrylic acid or by the partial hydrolysis of preformed polyacrylamides. Anionic polyacrylamides with a molecular weight of greater than approximately 1 million, preferably 10–20 million, and containing 10–70 mole % of acid groups are preferred. Other high molecular weight anionic polymers formed by the (co)polymerization of various vinyl monomers can also be used.

These compounds, generally comprising approximately 0.01–1% by weight of a solution when added to the furnish (added together or separately in any order) can comprise approximately up to 10% by weight of the dry furnish weight.

Generally, the weight ratio of PSM/cationic polymer can be 1:100 to 100:1 and of cationic polymer/anionic polymer of 100:1 to 1:100.

The aqueous furnish can contain, in addition to the customarily utilized cellulosic materials and inorganic fillers, an aluminum salt. Optionally, some or all of such salt can be combined with the PSM and/or other polymers. Furthermore, other chemicals can also be added to boost the cationic nature of the furnish to balance the detrimental effects of anionic impurities in the system, including low molecular weight, high charge density polyamines such as polyethyleneimine, amine-epichlorohydrin condensation products, and polydiallyldimethylammonium chloride.

EXAMPLE

When comparison tests were carried out between a colloidal silica-based system, as described in U.S. Pat. No. 4,643,801 and the system of this invention, substantial improvement in formation of paper was noted with the system of this invention. The formation of freesheet produced was monitored with a Kimberly Clark formation meter measuring the light transmitted from a light source through a disc of paper rotated both radially and eccentrically. The results are expressed as a formation number; the higher the number the better the formation of paper.

A measurement of formation of paper with colloidal silica-based system (8 random samples) resulted in a mean formation number of 167. Measurement with the system of this invention (utilizing one-half as much weight of PSM when compared to colloidal silica, given the known higher retention and drainage activity of polysilicate microgels over colloidal silica) resulted in a mean formation number (9 random samples) of 185, an unexpectedly higher formation number, while maintaining retention and drainage properties.

I claim:

1. A process to improve formation of paper during papermaking over processes utilizing colloidal silicas while maintaining retention and drainage properties comprising the steps:

(A) adding to an aqueous paper furnish containing pulp and, optionally, inorganic filler, a mixture of (i) polysilicate microgel (PSM) in amounts sufficient to maintain retention and drainage properties achieved by processes utilizing colloidal silicas, (ii) cationic polymer selected from the group consisting of high molecular weight cationic starch, high molecular weight cationic polyacrylamide, and high molecular weight cationic guar gum in weight ratios of PSM:cationic polymer of from 1:100 to 100:1; and (iii) anionic polymer selected from the group consisting of anionic polyacrylamide and anionic copolymers of vinyl polymers in weight ratios of cationic polymer:anionic polymer of from 1:100 to 100:1;

wherein the polysilicate microgel, cationic polymer and amionic polymer are present in an amount of $\leqq 10\%$ by weight of the dry furnish weight; and (B) forming and drying the product of step (A).

2. The process of claim 1 wherein the polysilicate microgel is a network of silica particles of approximately 1–2 nm diameter size and surface area of $\geqq 1000\ m^2$.

3. The process of claim 1 wherein the anionic polymer is anionic polyacrylamide.

4. The process of claim 3 wherein the polyacrylamide has a molecular weight of greater than approximately 1 million and contains 10–70 mole % of acid groups.

* * * * *